US008602825B2

(12) United States Patent
Chen

(10) Patent No.: US 8,602,825 B2
(45) Date of Patent: Dec. 10, 2013

(54) ELECTRICAL CONNECTOR WITH SPECIALLY DESIGNED METAL CONTACT TERMINALS TO AVOID SOLDER-OFF

(75) Inventor: Po-Jung Chen, Taoyuan County (TW)

(73) Assignee: U.D. Electronic Corp., Taoyuan, Taoyuan County (TW)

( * ) Notice: Subject to any disclaimer, the term of this patent is extended or adjusted under 35 U.S.C. 154(b) by 82 days.

(21) Appl. No.: 13/430,227

(22) Filed: Mar. 26, 2012

(65) Prior Publication Data

US 2013/0252466 A1 Sep. 26, 2013

(51) Int. Cl.
*H01R 24/00* (2011.01)

(52) U.S. Cl.
USPC ..... 439/660

(58) Field of Classification Search
USPC ..... 439/660, 638, 78, 607.4, 188, 222; 361/737
See application file for complete search history.

(56) References Cited

U.S. PATENT DOCUMENTS 7,744,426 B2 * 6/2010 Zheng et al. ..... 439/660
7,833,065 B2 * 11/2010 Lin et al. ..... 439/639
7,872,873 B2 * 1/2011 Hiew et al. ..... 361/737
7,927,145 B1 * 4/2011 Chang ..... 439/607.31
8,398,416 B2 * 3/2013 Tseng ..... 439/188
8,408,940 B2 * 4/2013 Chang ..... 439/607.01
8,460,036 B1 * 6/2013 Chen ..... 439/660
8,480,436 B2 * 7/2013 Chang ..... 439/660
8,500,463 B2 * 8/2013 Tsai et al. ..... 439/78
2010/0203751 A1 * 8/2010 Tsai ..... 439/222

* cited by examiner

*Primary Examiner* — Alexander Gilman
(74) *Attorney, Agent, or Firm* — Muncy, Geissler, Olds & Lowe, PLLC

(57) ABSTRACT

An electrical connector includes an electrically insulative holder member, a signal module formed of a circuit board with longitudinal terminal holes, circuit lines, electrical contacts and via-holes, metal contact terminals and metal mounting terminals, and a metal shield. The metal contact terminals have rear soldering end portions thereof soldered to respective circuit lines, an extension arm forwardly extended from the rear soldering end portion along one longitudinal terminal hole, a turn portion extended from the extension arm and curved into the associating longitudinal terminal hole to enhance vertical deformation stroke of the respective metal contact terminal, a front contact portion suspending below the associating longitudinal terminal hole, and an oblique spring arm connected between the turn portion and the front contact portion to flexibly support the front contact portion.

4 Claims, 5 Drawing Sheets

ELECTRICAL CONNECTOR WITH SPECIALLY DESIGNED METAL CONTACT TERMINALS TO AVOID SOLDER-OFF

BACKGROUND OF THE INVENTION

1. Field of the Invention

The present invention relates to electrical connector technology and more particularly, to an electrical connector with specially designed metal contact terminals, which avoids permanent deformation of metal terminals or solder-off.

2. Description of the Related Art

Following fast development of computer technology, high mobility notebook computer has been well developed and widely used by people to substitute for desk computer. Further, when connecting a computer to a peripheral apparatus for transmitting data or signal, a peripheral interface means is necessary. USB (universal serial bus) is the mainstream interface, having hot plug function.

Further, following the market trend to make computers and peripheral devices having a small size characteristic, the problem of internal signal interference due to magnetic effects must be taken into account. Interferences may come from conducted disturbance that occurs during signal transmission through power circuits and/or signal lines of the circuit board to the electrical connector, or radiated disturbance that occurs due to the radiation of magnetic waves around the electrical connector. As a USB 3.0 connector uses a large number of conducting terminals that are arranged in a limited mounting area, approaching between two conducting terminals or curving of any conducting terminal may cause disturbance (static interference, electromagnetic interference, impedance matching, noise interface, crosstalk interference) during the transmission of a high-frequency signal. Further, EMI (electromagnetic interference) and noises can be eliminated or reduced during signal transmission between a USB 3.0 connector and a system mainboard interface only if impedance matching condition is satisfied. Improper impedance matching can cause signal reflection and noise interference, resulting in signal loss, signal deformation and/or signal distortion. When this problem occurs, the electronic system (computer or network system) may be unable to function normally.

Further, a circuit board design of tongue plate has copper foil contacts arranged on a plane. For example, an HDMI socket connector is based on this design. Further, a circuit board design of tongue plate for USB 3.0 female connector has 5 pcs of copper foil contacts and 4 pcs of springy metal contact terminals. When a USB 3.0 male connector is inserted into a USB 3.0 female connector, the arrangement of the springy metal contact terminals at the circuit board design of tongue plate of the USB 3.0 female connector may causes serious mechanism problems. The first problem is that the positioning of the front contact portions of the springy metal contact terminals on the top side of the circuit board design of tongue plate may be directly impacted by the mating metal contact terminals of the USB 3.0 male connector, due to positioning displacement or large tolerance, causing disconnection of the spring metal contact terminals from the circuit board design of tongue plate. The second problem is that the springy metal contact terminals may be squeezed toward the circuit board design of tongue plate by a lateral force upon insertion of the USB 3.0 male connector into the USB 3.0 female connector, causing damage or disconnection of the rear soldering portions of the springy metal contact terminals from the circuit board design of tongue plate. A third problem is that the circuit board design of tongue plate has no room for allowing the springy metal contact terminals to be elastically and heavily deformed and the springy metal contact terminals may be permanently deformed.

Therefore, it is desirable to provide an electrical connector, which eliminates the aforesaid problems.

SUMMARY OF THE INVENTION

The present invention has been accomplished under the circumstances in view. It is therefore the main object of the present invention to provide an electrical connector, which avoids permanent deformation of metal terminals or solder-off.

To achieve this and other objects of the present invention, an electrical connector comprises an electrically insulative holder member, a signal module mounted in the holder member, and a metal shield surrounding the holder member and the signal module. The electrically insulative holder member comprises a holder base, and a tongue plate suspending in the front side of the holder base. The tongue plate comprises at least one opening in the bottom side thereof and five contact holes arranged in a transverse line in a front side relative to the at least one opening. The signal module comprises a circuit board, which comprises a plurality of longitudinal terminal holes, a plurality of circuit lines, a plurality of electrical contacts and a plurality of via-holes, a plurality of metal contact terminals, and a plurality of metal mounting terminals. The metal contact terminals are respectively mounted in the circuit board corresponding to the longitudinal terminal holes, each comprising a rear soldering end portion electrically soldered to one circuit line, an extension arm forwardly extended from said rear soldering end portion along a top side of one said longitudinal terminal hole, a turn portion extended from one end of said extension arm opposite to said rear soldering end portion and curved into the associating longitudinal terminal hole and stopped at a front end of the associating longitudinal terminal hole, a front contact portion suspending below the associating longitudinal terminal hole outside said circuit board, and an oblique spring arm connected between said turn portion and said front contact portion. The metal mounting terminals are respectively soldered to the via-holes of the circuit board.

As the extension arms are supported on the inside wall inside the insertion chamber of the tongue plate and the turn portions are respectively stopped at the front ends of the respective longitudinal terminal holes, the extension arms and the turn portions limit the extent of deformation of the oblique spring arms, avoiding excessive deformation of the metal contact terminals or disconnection of the rear soldering end portions of the metal contact terminals from the respective soldered points.

DETAILED DESCRIPTION OF THE PREFERRED EMBODIMENT

Figure 1:
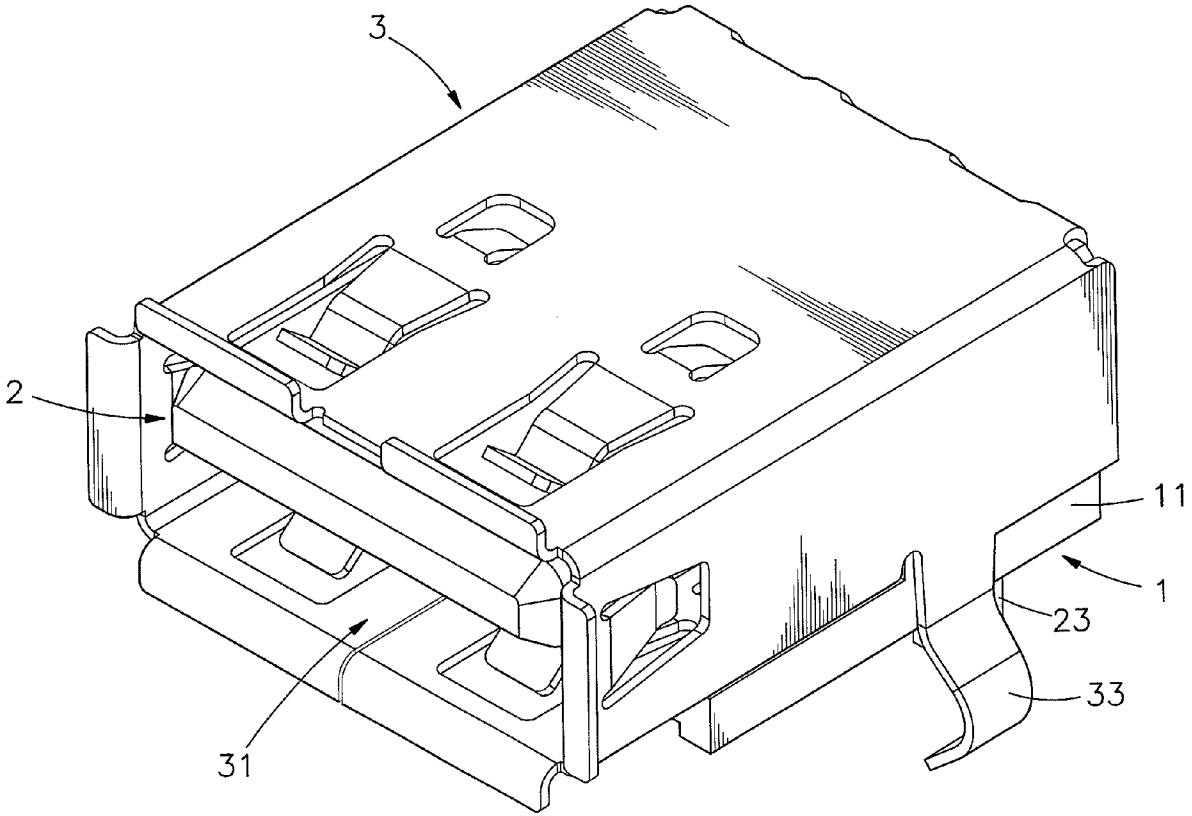
FIG. 1 is an oblique top elevational view of an electrical connector in accordance with the present invention.
Figure 2:
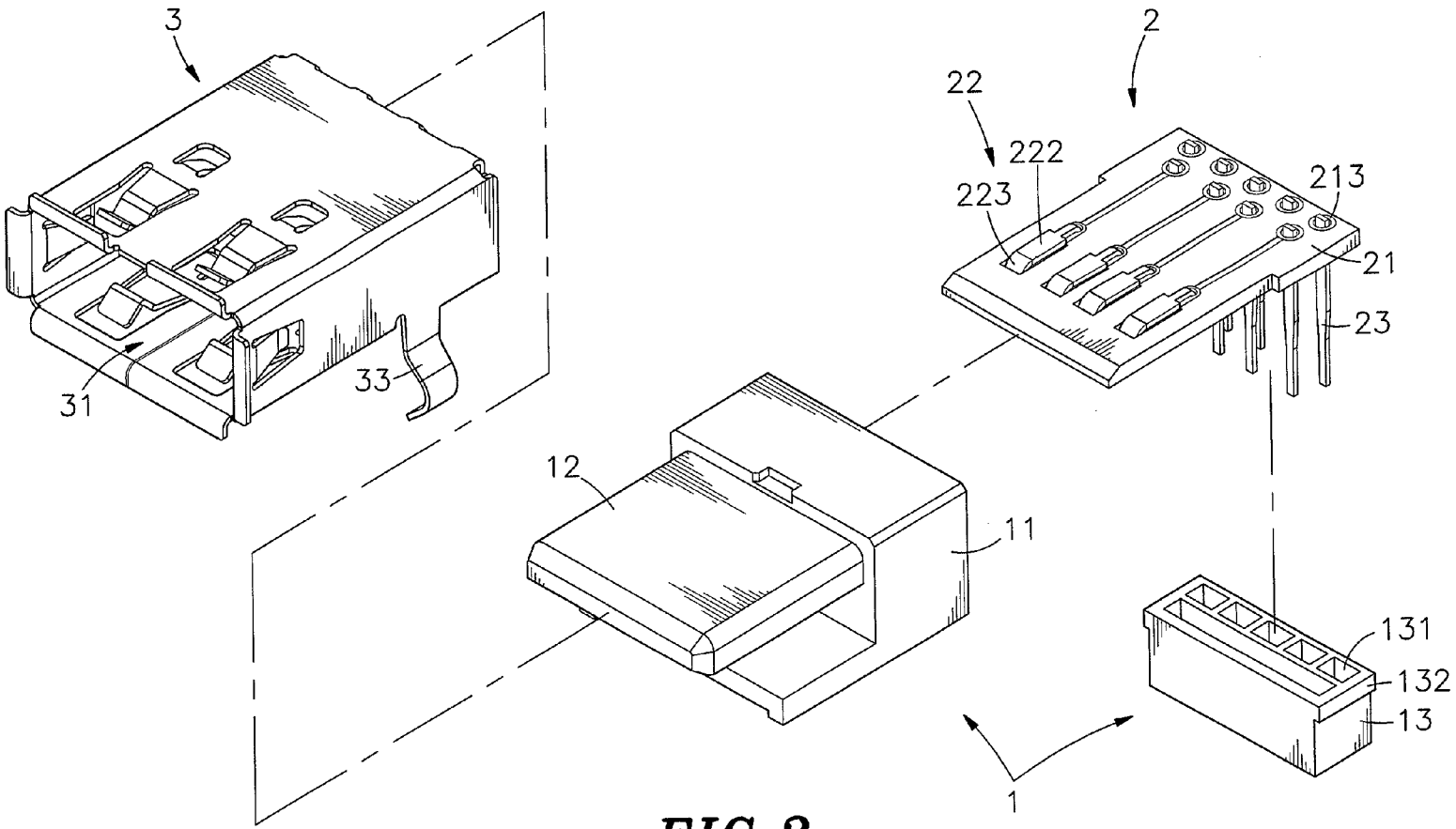
FIG. 2 is an exploded view of the electrical connector in accordance with the present invention.
Figure 3:
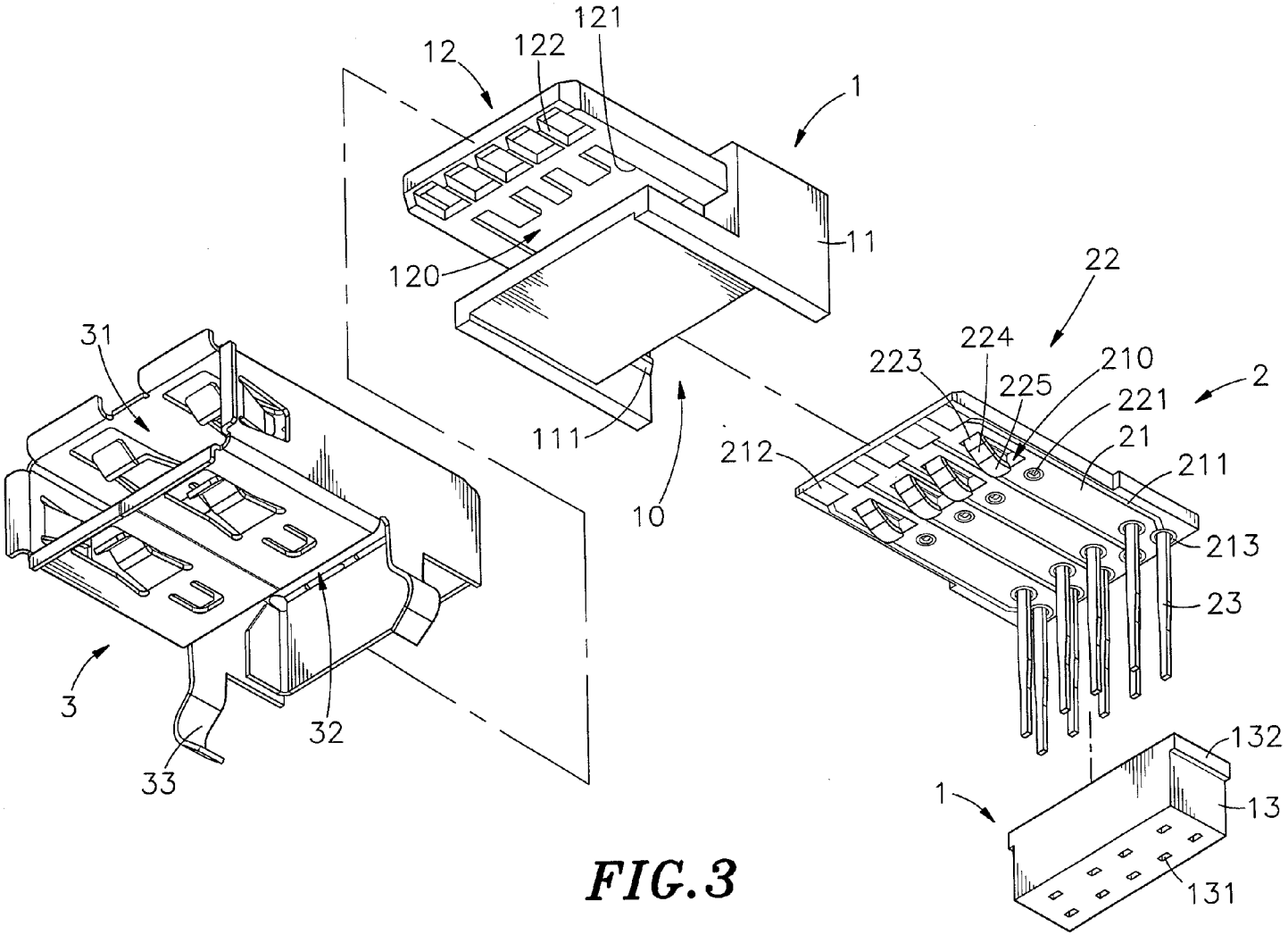
FIG. 3 corresponds to FIG. 2 when viewed from another angle.
Figure 4:
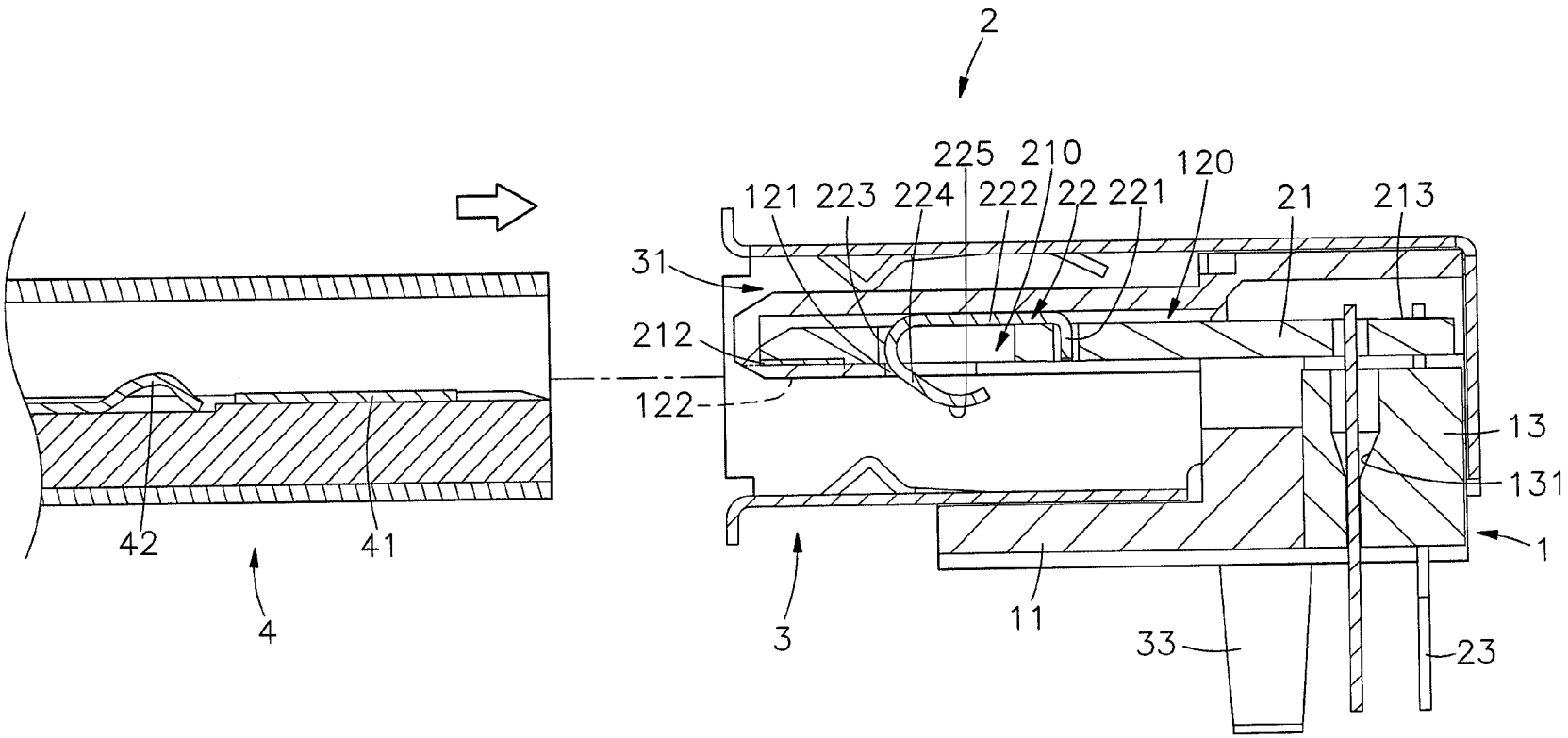
FIG. 4 is a sectional applied view of the present invention before insertion of a mating electrical connector.

Reference will be made in detail to the preferred embodiment of the invention, an example of which is illustrated in the accompanying drawings. Wherever possible, like reference numbers are used in the drawings and the description to refer to like parts.

Referring to FIGS. 1, 2, 3 and 4, an elevational view, an exploded view, an exploded view viewed from another angle and a sectional side view in an enlarged scale of an electrical connector in accordance with the present invention are respectively shown. The electrical connector comprises an electrically insulative holder member 1, a signal module 2, and a metal shield 3.

The electrically insulative holder member 1 comprises a holder base 11, a tongue plate 12, and a partition block 13. The holder base 11 defines an accommodation open chamber 10 in the rear bottom side thereof, and two inside retaining flanges 111 symmetrically disposed at two opposite lateral sides in the accommodation open chamber 10. The tongue plate 12 suspends in the front side of the holder base 11, defining an insertion chamber 120 therein, at least one opening 121 in a bottom side thereof in communication with the insertion chamber 120, and five contact holes 122 in a transverse line in front of the at least one opening 121. The partition block 13 defines a plurality of through holes 131 vertically cut through opposing top and bottom sides thereof and arranged in two lines, and two coupling flanges 132 symmetrically disposed at two opposite lateral sides corresponding to the inside retaining flanges 111 of the holder base 11.

The signal module 2 comprises a horizontally extending circuit board 21, a plurality of metal contact terminals 22, and a plurality of metal mounting terminals 23. The circuit board 21 defines therein a plurality of longitudinal terminal holes 210, a plurality of circuit lines 211, a plurality of electrical contacts 212, and a plurality of via-holes 213. The metal contact terminals 22 are respectively set in the longitudinal terminals holes 210 of the circuit board 21, each comprising a rear soldering end portion 221 electrically soldered to one respective circuit line 211 at the circuit board 21, an extension arm 222 forwardly extended from the rear soldering end portion 221 along the top side of one respective longitudinal terminal hole 210, a turn portion 223 extended from one end of the extension arm 222 opposite to the rear soldering end portion 221 and curved into the respective longitudinal terminal hole 210, a front contact portion 225 suspending below the respective longitudinal terminal hole 210 outside the circuit board 21, and an oblique spring arm 224 connected between the turn portion 223 and the front contact portion 225. According to this embodiment, the metal contact terminals 22 are configured subject to USB 2.0 specification, i.e., the number of the metal contact terminals 22 is 4; the electrical contacts 212 are configured to match with the metal contact terminals 22 subject to USB 3.0 specification, i.e., the number of the electrical contacts 212 is 5; the electrical contacts 212 and the front contact portion 225 are respectively arranged in a respective line in a staggered manner; the number of the via-holes 131 is 9, i.e., four via-holes 131 are arranged in a first line at the front side and the other five via-holes 131 are arranged in a second line at the rear side. Further, the metal contact terminals 22 and the electrical contacts 212 are respectively electrically connected to the via-holes 213 by the circuit lines 211. The metal mounting terminals 23 are respectively soldered to the via-holes 213 and vertically downwardly extended from the circuit board 2.

Further, the rear soldering end portions 221 of the metal contact terminals 22 and the metal mounting terminals 23 are respectively soldered to the circuit lines 211 and via-holes 213 of the circuit board 21 by SMT (surface mounting technology) and through-hole technology. However, this mounting arrangement is not a limitation. SMT (surface mounting technology) and through-hole technology may be selectively employed to solder the rear soldering end portions 221 of the metal contact terminals 22 and the metal mounting terminals 23 to the circuit lines 211 and the via-holes 213 subject to different design requirements. Further, the circuit board 21 can be a single layer board, or multi-layer board. The metal shield 3 comprises a front receiving hole 31, a rear accommodation chamber 32 disposed in communication with the front receiving hole 31, and two bottom mounting legs 33 respectively downwardly extended from two opposite lateral sides thereof.

Referring to FIGS. 1-4 again, during installation of the electrical connector, solder the rear soldering end portions 221 of the metal contact terminals 22 and the metal mounting terminals 23 to the circuit lines 211 and the via-holes 213 of the circuit board 21 respectively, and then insert the circuit board 21 forwardly through the accommodation open chamber 10 of the holder base 11 into the insertion chamber 120 of the tongue plate 12 to keep the front contact portions 225 of the metal mounting terminals 23 suspending outside the at least one opening 121 of the tongue plate 12 and simultaneously to force the electrical contacts 212 into the respective contact holes 122. Thereafter, attach the partition block 13 upwardly to the inside of the accommodation chamber 10 of the holder base 11 to let the metal mounting terminals 23 be respectively inserted through the respective through holes 131 of the partition block 13 and the coupling flanges 132 be respectively forced into engagement with the inside retaining flanges 111 of the holder base 11. Thus, the signal module 2 is positively positioned in the accommodation chamber 10 of the holder base 11. Thereafter, wrap the metal shield 3 about the electrically insulative holder member 1 and the signal module 2 to have the electrically insulative holder member 1 be positioned in the rear accommodation chamber 32 of the metal shield 3 and the circuit board 21 with the tongue plate 12 be positioned in the front receiving hole 31. Thus, the 5 pcs of electrical contacts 212 of the circuit board 21 are respectively disposed in the contact holes 122 of the tongue plate 12; the metal contact terminals 22 are spaced behind the electrical contacts 212 in a staggered manner with the front contact portions 225 thereof suspending outside the at least one opening 121 of the tongue plate 12; the circuit lines 211 respectively electrically connect the electrical contacts 212 and the metal contact terminals 22 to the 9 pcs of via-holes 213.

Figure 5:
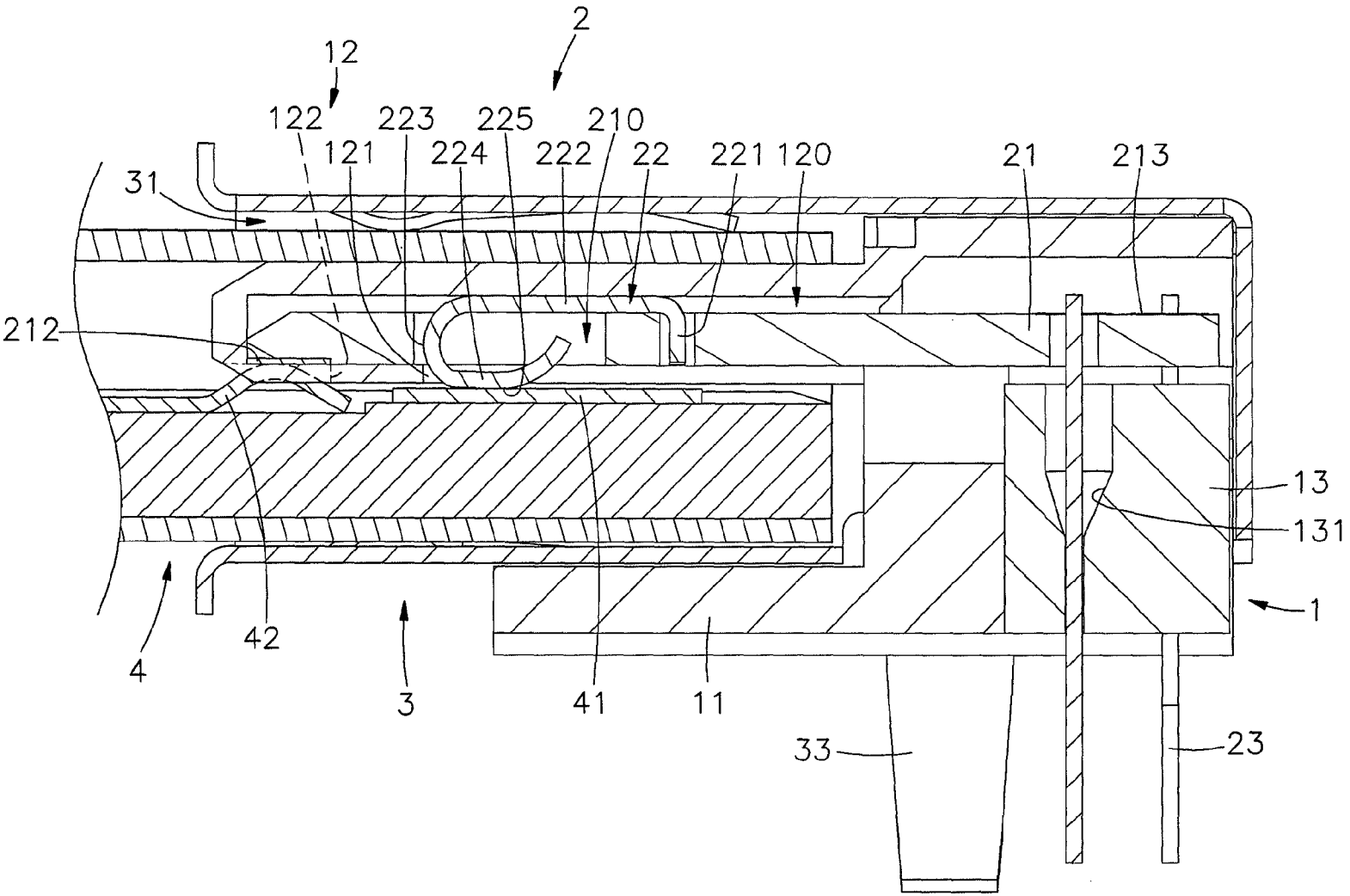
FIG. 5 corresponds to FIG. 4, illustrating the mating electrical connector inserted into the front receiving hole of the metal shield and electrically connected to the signal module.

Referring to FIG. 5 and FIGS. 2-4 again, when using the electrical connector, a mating (USB male) connector 4 is inserted into the front receiving hole 31 of the metal shield 3, and the internal front flat terminals 41 and rear conducting terminals 42 of the mating (USB male) connector 4 are respectively forced into contact with the metal contact terminals 22 and the electrical contacts 212 of the signal module 2. However, when moving the front flat terminals 41 of the mating (USB male) connector 4 toward the metal contact terminals 22, the front contact portions 225 of the metal contact terminals 22 will be respectively stopped against the front flat terminals 41 of the mating (USB male) connector 4 to deform the associating oblique spring arms 224 toward the inside of the respective longitudinal terminal holes 210. As the extension arms 222 are supported on the inside wall inside the insertion chamber 120 of the tongue plate 12 and the turn portions 223 are respectively stopped at the front ends of the respective longitudinal terminal holes 210, the extension arms 222 and the turn portions 223 limit the extent of deformation of the oblique spring arms 224, avoiding excessive deformation of the metal contact terminals 22 or disconnection of the rear soldering end portions 221 of the metal contact terminals 22 from the respective soldered points (the circuit lines 211). Further, subject to the design of the longitudinal terminal holes 210, the front contact portions 225 can have a relatively greater deformation stroke in vertical direction, ensuring a high level of positioning stability of the metal contact terminals 22. Thus, the design of the present invention facilitates quick installation and assures a high level of reliability.

Referring to FIG. 3 again, as stated above, the signal module 2 comprises 5 pcs of electrical contacts 212 and 4 pcs of metal contact terminals 22. The electrical contact 212 at the midpoint is for grounding. The other 4 pcs of electrical contacts 212 that are symmetrically disposed at two opposite lateral sides are for signal transmission. The left and right-sided metal contact terminals 22 are respectively the power terminal and the grounding terminal. The other two metal contact terminals 22 on the middle are for signal transmission. Thus, during transmission of high-frequency signal through the respective signal-transmission electrical contacts 212 and signal-transmission metal contact terminals 22, the grounding electrical contact 212 and the respective grounding circuit line 211 guide electromagnetic waves to the respective grounding metal mounting terminal 23 for discharge, eliminating or reducing EMI (electromagnetic interference) and/or cross talk.

Referring to FIGS. 2, 3 and 5 again, as stated above, when the mating (USB male) connector 4 is inserted into the electrical connector, the internal front flat terminals 41 and rear conducting terminals 42 of the mating (USB male) connector 4 are respectively forced into contact with the metal contact terminals 22 and the electrical contacts 212 of the signal module 2. As the extension arms 222 and turn portions 223 of the metal contact terminals 22 are respectively supported on the inside wall inside the insertion chamber 120 of the tongue plate 12 stopped at the front ends of the respective longitudinal terminal holes 210, the extension arms 222 and the turn portions 223 of the metal contact terminals 22 limit the extent of deformation of the associating oblique spring arms 224 when the front flat terminals 41 of the mating (USB male) connector 4 are forced into contact with the front contact portions 225 of the metal contact terminals 22, avoiding excessive deformation of the metal contact terminals 22 or disconnection of the rear soldering end portions 221 of the metal contact terminals 22 from the respective soldered points (the circuit lines 211).

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electrical connector, comprising:

an electrically insulative holder member comprising a holder base and a tongue plate suspending in a front side of said holder base, said tongue plate defining an insertion chamber therein, at least one opening in a bottom side thereof in communication with said insertion chamber and five contact holes in a transverse line in a front side relative to said at least one opening; and a signal module comprising a circuit board horizontally supported on said holder base of said electrically insulative holder member, said circuit board comprising a plurality of longitudinal terminal holes, a plurality of electrical contacts respectively disposed in said contact holes of said tongue plate, a plurality of via-holes arranged in two lines near a rear side thereof and a plurality of circuit lines, a plurality of metal contact terminals respectively mounted in said circuit board corresponding to said longitudinal terminal holes, each said metal contact terminal comprising a rear soldering end portion electrically soldered to one said circuit line, an extension arm forwardly extended from said rear soldering end portion along a top side of one said longitudinal terminal hole, a turn portion extended from one end of said extension arm opposite to said rear soldering end portion and curved into the associating longitudinal terminal hole and stopped at a front end of the associating longitudinal terminal hole, a front contact portion suspending below the associating longitudinal terminal hole outside said circuit board and an oblique spring arm connected between said turn portion and said front contact portion, and a plurality of metal mounting terminals respectively soldered to said via-holes of said circuit board and inserted through the through holes of said holder base, said metal contact terminals being configured subject to USB 2.0 specification, said electrical contacts being configured to match with said metal contact terminals subject to USB 3.0 specification, said electrical contacts and the front contact portion of said metal contact terminals being respectively arranged in a respective line in a staggered manner, said metal contact terminals and said electrical contacts being respectively electrically connected to said via-holes by said circuit lines.

2. The electrical connector as claimed in claim 1, wherein said holder base of said electrically insulative holder member defines an accommodation open chamber in a rear bottom side thereof for accommodating said signal module; said electrically insulative holder member further comprises a partition block mounted in said accommodation open chamber and attached to a bottom side of said circuit board of said signal module, said partition block comprising a plurality of through holes for the passing of said metal mounting terminals.

3. The electrical connector as claimed in claim 1, further comprising a metal shield surrounding said electrically insulative holder member and said signal module, said metal shield comprising a front receiving hole accommodating said circuit board and said tongue plate, and a rear accommodation chamber accommodating said electrically insulative holder member.

4. The electrical connector as claimed in claim 3, wherein said metal shield further comprises a plurality of bottom mounting legs respectively downwardly extended from two opposite lateral sides thereof for mounting.

* * * * *